United States Patent [19]

Rodriguez

[11] 4,325,051

[45] Apr. 13, 1982

[54] PTCR PACKAGE

[75] Inventor: George H. Rodriguez, Williamstown, Mass.

[73] Assignee: Sprague Electric Company, North Adams, Mass.

[21] Appl. No.: 182,565

[22] Filed: Aug. 29, 1980

[51] Int. Cl.[3] ..... H01C 13/00; H01C 7/02

[52] U.S. Cl. ..... 338/220; 29/610 R; 338/225 D; 338/309; 338/327; 338/322; 338/25

[58] Field of Search ..... 338/25, 220, 22 R, 22 SD, 338/309, 322, 324, 327, 328, 332; 29/610, 621; 318/471–474

[56] References Cited

U.S. PATENT DOCUMENTS 3,737,752 6/1973 Strachan ..... 338/220 X
3,750,082 7/1973 Petersen et al. ..... 338/220
3,794,949 2/1974 Larsen et al. ..... 338/22 R
3,921,117 11/1975 Blaha ..... 338/220
4,053,864 10/1977 Rodriguez et al. ..... 338/327 X

*Primary Examiner*—C. L. Albritton
*Attorney, Agent, or Firm*—Connolly and Hutz

[57] ABSTRACT

A PTCR ceramic slug having glass bonded aluminum electrodes is held firmly sandwiched between opposing inner walls in the cavity of a plastic housing by two identical resilient base-metal pieces on either major face of the slug. Each metal piece has metal fingers making spring loaded contact with the adjacent electroded face of the slug to effect the above noted holding and to form base-metal to base-metal electrical contacts. Each metal piece has at least one portion extending through a hole in the housing to provide electrical access to the PTCR slug.

10 Claims, 5 Drawing Figures

PTCR PACKAGE

BACKGROUND OF THE INVENTION

This invention relates to a positive temperature coefficient resistor package and more particularly to a package containing a PTCR ceramic slug with glass bonded aluminum electrodes being electrically connected by pressure contacts from two identical unitary resilient metal pieces that also provide space terminal and pin socket functions.

PTCR resistors are commonly connected in series with the auxillary or start winding of a motor. Such PTCR resistors have a low resistance at room temperature but when the temperature is raised above the characteristic anomally temperature (typically 120° C.) they present a high resistance. The circuit is first activated, a large current flows (typically for 0.25 seconds) before by self heating the PTCR resistor body becomes highly resistive effectively reducing the current in the start winding one or more orders of magnitude. A further description of such a system is described in U.S. Pat. No. 3,965,392 issued June 22, 1976 and assigned to the same assignee as is the present invention.

Of special interest here is a PTCR resistor to be used in domestic refrigerators. Such refrigerators commonly employ a heremetically sealed chamber that houses the compressor and motor. Electrical access is had via a glass to metal hermetically sealed header, typically having three equally spaced (usually 0.46 inches or 117 mm.) circular pins of about 0.09 inch or 2.3 mm. diameter. A first and second of these pins may lead to the main winding and the auxiliary winding of the motor respectively, while the third pin is common to the other ends of those windings. Thus, the PTCR resistor is connected across the latter two pins. Refrigerator manufacturers prefer that the PTCR resistor package include sockets that make electrical contact to and also physically mount to the aforesaid latter two pins, and further require that spade terminals be provided by the package to which electrical connection to other parts of the refrigerator control circuit may be had.

The pin socket, slug contacting and spade terminal functions have heretofore been implemented by an assembly of dissimilar metal pieces, that require separate tooling.

It is of major importance that for such applications that the PTCR resistor package be capable of production at very low cost. Pressure contacts rather than solder or otherwise bonded connections to the ceramic slug electrodes are much preferred because of their relatively low cost. However, heretofore only electrodes containing precious metals, usually silver, were suitable for pressure contacting.

It is an object of the present invention to provide a low cost PTCR resistor package containing a PTCR slug with glass bonded aluminum electrodes that are free of precious metals and are pressure contacted.

SUMMARY OF THE INVENTION

A positive temperature coefficient resistor package includes a PTCR ceramic slug with two glass bonded aluminum electrodes attached to opposing slug faces. At least two metal contact pads are in pressure contact with each of the two electrodes, respectively. The metal contact pads each have a slightly curved convex surface toward the corresponding contacted of the electrodes. The area of a convex surface portion of each pad is from 0.00025 to 0.0067 square inches (0.16 to 4.3 $mm^2$) wherein that surface portion is defined as the portion which would be in contact with the electrode if the pad had been pressed into the electrode to a depth of 0.002 inch (0.05 mm). The force by which each contact is held in pressure contact with an electrode divided by the above noted area represents a contact pressure that is greater than 600 p.s.i. (42 $Kg/cm^2$).

The most effective designs are those in which the pressure is substantially greater. During motor-start service each pad actually penetrates part way into the contacted electrode. The end of life pressure and depth of electrode penetration are determined by the size and shape of the contact pads and the contact force which are established during manufacture. The contact pads are of a base metal making base metal to base metal contact with the aluminum electrode.

The FIGS. 1, 2, 3 and 4 are drawn approximately to the same scale.

Figure 3:
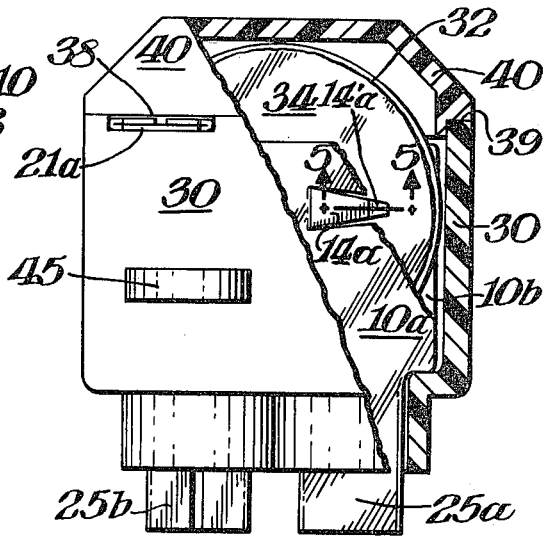
FIG. 3 shows in a front view a PTCR resistor package of this invention including two identical metal pieces, one of which is shown in FIGS. 1 and 2. The case is partially broken away to reveal the PTCR slug and the two metal pieces.
Figure 5:
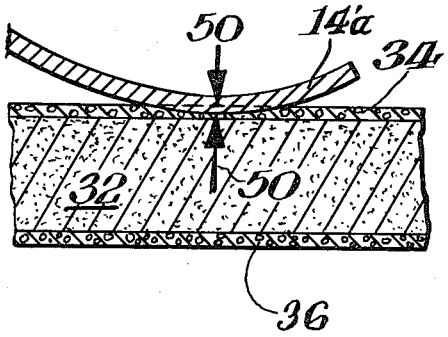

FIG. 5 shows a magnified detail in cross-sectional view taken in plane 5—5 of FIG. 3 of a pressure contact between a resilient metal finger and an electrode of the PTCR slug.

DESCRIPTION OF THE PREFERRED EMBODIMENTS

Figure 1:
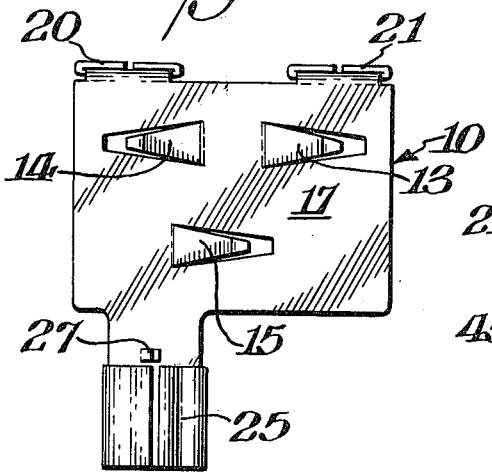
FIG. 1 shows in a front view a unitary sheet metal piece having been cut and bent to provide pressure contacts to a PTCR resistor slug, a pin socket and two spade terminals.
Figure 2:
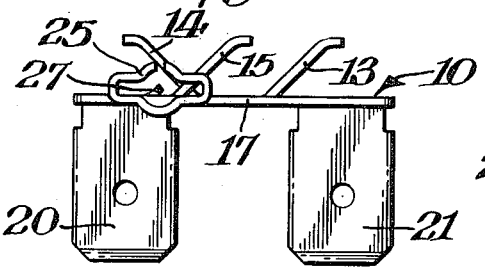
FIG. 2 shows in bottom end view the metal piece of FIG. 1.

The multi-function metal piece 10 shown in FIGS. 1 and 2 is formed by cutting (e.g. punching) and bending a resilient phosphor-bronz sheet having a thickness of 0.015 inch (0.38 mm.). Three contact fingers 13, 14 and 15, are partially cut from and raised to one side away from the flat body portion 17 of the piece 10. Two extended portions 20 and 21 are folded back flat upon themselves to form two spade terminals, i.e., the male parts of quick-connect/disconnect electrical connectors typically employed in domestic appliances. One industry standard for such connectors calls for a spade terminal thickness of about 0.030 inch (0.76 mm.) for carrying currents on the order of 20 amperes. The folded metal terminals 20 and 21 meet that requirement.

Another extended portion 25 is bent in the form of a resilient female socket that will mate with a male pin (not shown). The cut and raised portion 27 serves as a stop for the mating pin.

Figure 4:
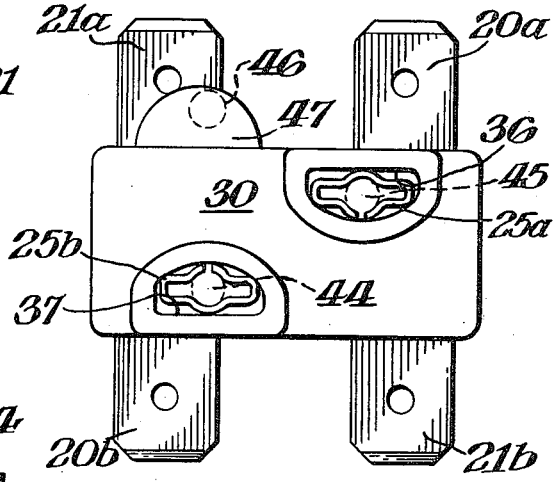
FIG. 4 shows in a bottom end view the package of FIG. 3.

Referring to FIGS. 3, 4 and 5, a hollow plastic case 30 contains two identical metal pieces 10*a* and 10*b* each as illustrated in FIG. 1, as well as a discoidal semiconducting ceramic slug 32. An aluminum electrode layer 34 is bonded to one end face of the discoidal slug 32 and another (not shown) is bonded to the opposite back end face of slug 32. The tips of the fingers, e.g. 14*a*, of metal piece 10*a* serve as contact pads, e.g. 14*a'*, that are in pressure contact with electrode layer 34. Similarly, the tips of the fingers (not shown) of metal piece 10*b* are in pressure contact with the opposite electrode layer 36. The above noted contact pressure results from the confinement of piece 10*a*, slug 32, and piece 10*b* between interior surfaces of opposite side wall portions of case 30. In other words, these parts are dimensioned so that after assembly, the contact fingers are compressed to a predetermined degree.

The assembly may be accomplished by sandwiching slug 32 between the pieces 10*a* and 10*b*, compressing the resulting stack and inserting it into the cavity of case 30 so that sockets 25*a* and 25*b* are inserted into holes 36 and 37, respectively, that are provided therefor in the bottom end face of the case 30. At the same time, the spade terminals (e.g. 21*a*) are received in slots (e.g. 38) provided therefor in the rim 39 at the open end of case 30. A plastic cover 40 is subsequently fitted over the open end of case 30 and the cover 40 and case 30 are ultrasonically bonded to each other.

In FIG. 4, the relative locations of three pins 44, 45 and 46 are shown (by broken lines), when the PTCR package is mounted to an electrical header that includes pins 44, 45 and 46. The plastic wing 47, is provided by the case 30 to stop a female connector (not shown) that may have been mounted about pin 46.

The electrode layers, e.g. 34, consist of aluminum particles bound to each other and to the slug 32 by a lead silicate glass. Such glass bound aluminum electrodes for PTCR resistors are described in more detail by G. Rodriguez and J. Maher in U.S. Pat. No. 4,053,864 issued Oct. 11, 1977 and assigned to the same assignee as is the present invention. The compressed phospher bronze fingers, e.g. 13*a*, make direct base metal to base metal contact to the aluminum electrodes, e.g. 34, without any intervening silver or other conventional metal contact films such as palladium or copper.

When such a PTCR package serves a motor start function, it experiences a momentary pulse of very high current each time the motor is started. The service life of a PTCR package is commonly measured in terms of the number of such pulses required to cause it to fail. The major cause of failure for units having a pressure contacting means is the deterioration of the contact. With the aluminum electrodes of the present invention, insulating aluminum oxide tends to build up at the pressure pad to electrode contact interface when the contact pressure is too low and/or the current density is too high. During service, the pressure contacting pad presses into the electrode and if it is permitted to push completely through the electrode, arcing occurs and the contact resistance rises sharply leading to catastrophic failure.

Applicant has discovered that when the contact pressure is above a prescribed value and the area of contact, as determined by the area of the contacting pad, e.g., 14*a*′ is such that the maximum current density through the contact is limited to a value causing insubstantial local heating, breakdown of the glass and oxidation of the aluminum, then the number of operating cycles occurring before the contact deteriorates is comparable to that of conventional pressure contacts to PTCR slugs having silver containing or silver plated electrodes. It was also found that the glass bound aluminum electrode layers must be unusually thick, i.e. greater than about 0.002 inch (0.05 mm.).

A number of experiments were made, each involving eight 0.004 inch (0.10 mm) thick aluminum electrode layers contacted by a brass rod providing a well defined contact area and a well defined applied pressure. Current pulses of 60 Hz, 12 r.m.s. amperes amplitude and 0.25 seconds duration were passed through each of the contacts at a rate about 0.5 Hz. The key parameters in each of the experiments, 1 through 5 are shown in the Table below.

TABLE

| Ex. No. | Contact Area ($in^2$) | Contact Pressure (p.s.i.) | Current Density amps/$in^2$ | Cycles to Failure | |
|---|---|---|---|---|---|
| 1. | 0.00004 | 25,000 | 30,000 | (1st) | 26,000 |
| | | | | (2nd) | 45,000 |
| 2. | 0.01 | 100 | 1,200 | (1st) | 28,000 |
| 3. | 0.0007 | 1,400 | 17,140 | (1st) | 8,300 |
| | | | | (2nd) | 8,400 |
| | | | | (3rd) | 65,000 |
| | | | | (4th) | 66,000 |
| 4. | 0.0028 | 350 | 4,290 | (1st) | 100,000 |
| | | | | (2nd) | 104,000 |
| | | | | (3rd) | 684,000 |
| 5. | 0.0028 | 700 | 4,290 | (1st) | 627,000 |

For optimum life performance, analysis of the experimental results indicate that contact pressure should be at least as high as 600 p.s.i. (42 $Kg/cm^2$).

The above described PTCR package of FIGS. 1 through 4 employs three pressure contacts at each electrode (e.g. 34). The fingers are bent so as to provide an assembly force of 6 pounds and each pad (e.g. 14*a*′) is pressed against the corresponding electrode (e.g. 34) with a force of 2 pounds. Also the glass bonded aluminum electrodes (e.g. 34) have a thickness of 0.003 inch (0.076 mm). Eight such packages were built and subjected to a life test consisting of applying current pulses (i.e. between terminals 20*a* and 20*b*) of 12 amperes and 0.25 seconds duration.

After over 2 million cycles, no failures occurred. Units disassembled after 2 million cycles had contact depressions in the electrodes of about 0.001 square inch (0.65 $mm^2$) in area and penetration of the electrodes was to a depth of 0.002 inch (0.05 mm).

The above noted penetration (illustrated in FIG. 5) of the slightly curved pad 14*a*′ into the electrode (e.g. 34) occurs rapidly at first and then as the contacting area at the pad-electrode interface grows, the pressure diminishes and further penetration slows approaching an asymtotic depth. The asymtotic depth (distance between arrows 50) of 0.002 inch in the above described example, resulted in an ultimate contact area of 0.001 $in.^2$ and an ultimate contact pressure of 2 pounds/0.001 inch or 2000 p.s.i. (141 $Kg/cm^2$).

In a newly manufactured PTCR package of this invention, the penetration of the pads into the contacted of the electrode is less than the above noted ultimate or potential depth. However, from a knowledge of the assembly force, number of contact pads and the geometry of the curved contact pads (e.g. radius of curvature and width) the potential contact area can be determined, assuming an ultimate electrode penetration depth of 0.002 inch (0.05 mm).

For example, if the pad is cylindrical and has a radius of curvature R of 0.5 inch (13 mm) and the pad width W is 0.030 inch (0.76 mm), then the potential contact area Ac, defined at 0.002 inch (0.05 mm) penetration depth D, is very nearly $$Ac = 2W\sqrt{D(2R - D)}$$

or in this case 0.0027 in$^2$ (1.7 mm$^2$).

In the above described PTCR package, the case 30 is a thermoplastic material, namely polysulfone loaded 30% by weight with glass fibers, and the wall thickness is 0.060 inch (1.5 mm). For this case a total contacts force of greater than about 8 pounds (3.6 Kg) tends to distort the case and 8 pounds is generally considered to be a practical upper limit.

The 12 amperes employed in the above described experiments correspond to the starting currents occurring in the start winding of a typical domestic refrigerator motor. The data from these experiments, however, show that PTCR resistors used in conjunction with other fractional horse power motors may employ low cost aluminum electroded resistor slugs that are pressure contacted by contact pads having well defined areas. Either two or three fingers appears to provide the best compromise between contact pressure and maximum contact current density for most such applications.

Using a minimum contact pressure of 600 p.s.i., a maximum assembly force of 8 pounds and using two contacts at each electrode, it can be seen that the ultimate contact area in a PCTR package of the invention will be less than 4 lbs/600 p.s.i. or 0.0067 in.$^2$. Also, using the peak "start" current of 12 amperes in a three contacts per electrode package, and limiting the ultimate current density to 16000 amps./in.$^2$ leads to a minimum total potential contact area of 12 amps/16,000 amps./in.$^2$ or 0.00075 in.$^2$ (0.48 mm$^2$). The minimum ultimate contact area for each of three contacting pads is then 0.00025 in.$^2$ (0.16 mm$^2$).

It can thus be generalized that for use in PTCR packages with pressure contacts to glass bonded aluminum electrodes, a rating of 12 amperes peak service may be assigned and the potential contact area of each contacting pad will lie between 0.00025 and 0.0067 in.$^2$.

What is claimed is:

1. A positive temperature coefficient resistor (PTCR) package comprising:

(a) a PTCR ceramic slug having two major opposing faces;

(b) two glass bonded aluminum electrodes being bonded to said two opposing faces, respectively;

(c) a first group of at least two contact pads being in pressure contact with one of said electrodes and a second group of an equal number of contact pads being in pressure contact with the other of said electrodes; and (d) means for spring loading each of said metal contact pads against the corresponding contacted of said electrodes, each of said pads having a slightly curved convex surface toward said contacted electrode, the thickness of said glass bonded aluminum electrodes being greater than 0.002 inch to prevent said pads from completely pushing through said electrodes during the service life of said PTCR package.

2. The PTCR resistor package of claim 1 wherein the number of said contact pads in said first group is no greater than three.

3. The PTCR resistor package of claim 1 wherein the area of a convex surface portion of said each pad is from 0.00025 to 0.0067 square inches and wherein said surface portion is defined as that which would be in contact with said contacted electrode to a depth of 0.002 inches, the force of said holding divided by said area being greater than 600 pounds per square inch.

4. A positive temperature coefficient of resistance (PTCR) resistor package comprising (a) A PTCR ceramic slug having two major opposing faces;

(b) two glass bonded aluminum electrodes being bonded to said two opposing faces, respectively;

(c) two resilient sheet metal pieces, each having a plurality of fingers partially cut from and raised to one side away from the body of said each sheet metal piece, the tip of said each finger having a slight curvature serving as a contact pad, said two pieces being disposed on either side of said slug with the convex side of each said curved pad being in contact with one of said electrodes;

(d) a housing enclosing said slug and said metal pieces, each of said metal pieces being compressed between one of said electrodes and an inner wall of said housing with a force of less than 8 pounds to provide said pressure contacts, the thickness of each said glass bonded aluminum electrode being greater than 0.002 inch to prevent said pads from completely pushing through said electrodes during the service life of said PTCR package.

5. The PTCR resistor package of claim 4 wherein the area of convex surface portion of said each pad is from 0.00025 to 0.0067 square inches and wherein said surface portion is defined as that which would be in contact with said contacted electrode if said pad had been pressed into said contacted electrode to a depth of 0.002 inches, the force of said holding divided by said area being greater than 600 pounds per square inch.

6. The PTCR resistor package of claim 5, wherein the number of said fingers raised from each said metal piece is from 2 to 3.

7. The PTCR resistor package of claim 4 wherein each said metal piece additionally has an extended portion that is folded back upon itself to form a spade type terminal of about double the thickness of said sheet metal piece.

8. The PTCR resistor package of claim 4 wherein each said metal piece additionally has an extended portion that is bent to form a resilient female socket adapted for mating with a wire pin.

9. The PTCR resistor package of claim 8 wherein said spade and socket extended portions of said pieces extend through holes provided therefor in said housing.

10. The PTCR resistor package of claim 9 wherein said two metal pieces are identical so that both said pieces are capable of having been formed using the same sheet metal punching and bending tools.

* * * * *